US006161346A

United States Patent [19]

Richardson

[11] Patent Number: 6,161,346

[45] Date of Patent: Dec. 19, 2000

[54] GLAZED ROOFS

[75] Inventor: Christopher Richardson, Clitheroe, United Kingdom

[73] Assignee: Ultraframe (UK) Limited, Clitheroe, United Kingdom

[21] Appl. No.: 09/208,700

[22] Filed: Dec. 10, 1998

[51] Int. Cl.[7] ..... E04B 7/00; A01G 9/14; A01G 9/24

[52] U.S. Cl. ..... 52/198; 52/57; 52/90.1; 52/302.1; 52/DIG. 17; 47/17; 454/364; 454/365

[58] Field of Search ..... 47/17; 52/57, 90.1, 52/198, 199, 200, 218, 244, 302.1, DIG. 17; 454/358, 364, 365, 366

[56] References Cited

U.S. PATENT DOCUMENTS

| | | | |
|---|---|---|---|
| 1,518,691 | 12/1924 | Craig | 454/358 |
| 2,439,095 | 4/1948 | Mitchell | 52/199 X |
| 4,206,692 | 6/1980 | Johnston | 52/199 X |
| 4,438,680 | 3/1984 | Esposito | 52/DIG. 17 X |
| 5,901,528 | 5/1999 | Richardson | 52/783.1 |
| 5,924,263 | 7/1999 | Richardson | 52/734.2 |
| 5,927,027 | 7/1999 | Richardson | 52/90.1 X |
| 5,937,590 | 8/1999 | Richardson | 52/90.1 |
| 5,966,888 | 10/1999 | Richardson | 52/580 |
| 6,000,190 | 12/1999 | Richardson | 52/734.2 |
| 6,026,615 | 2/2000 | Richardson | 52/92.2 |
| 6,082,071 | 7/2000 | Richardson | 52/718.04 |

FOREIGN PATENT DOCUMENTS

| | | |
|---|---|---|
| 2701279A | 8/1994 | France . |
| 2223772A | 4/1990 | United Kingdom . |
| 2256880A | 12/1992 | United Kingdom . |

*Primary Examiner*—Carl D. Friedman
*Assistant Examiner*—Kevin D. Wilkens
*Attorney, Agent, or Firm*—Rockey, Milnamow & Katz, Ltd.

[57] ABSTRACT

A glazed roof has a ridge and at least one free ridge end, a ventilation path being provided through a ridge end component.

12 Claims, 5 Drawing Sheets

GLAZED ROOFS

This invention concerns improvements in glazed roofs.

The invention is particularly concerned with conservatory roofs and, more particularly, with means for ventilating conservatories. Conservatories are a popular addition to houses to provide additional room with the attractions of being light and providing wide outwards views. Because conservatories are glazed extensively, there can be disadvantages, in that, when the weather is hot the conservatory interior can become very hot and when the weather is cold, the glazing is not able to retain heat. As a consequence of the latter condensation can form on inner surfaces of a conservatory.

To combat these problems it is desirable to provide ventilation. One simple form of ventilation is to provide air passageways through the roof ridge of a conservatory, so that air can flow through the conservatory.

The ridge ventilation system does provide a large area over which rain ingress is possible i.e. along both sides of the ridge, where rain can splash upwards from roof glazing panels under a ridge cover and into the ridge beam. Therefore, rain baffles and other suitable seals have to be provided to prevent rain ingress into the conservatory itself.

An object of this invention is to provide an alternative ventilation system for a glazed roof structure.

According to this invention it is proposed that, for a glazed roof having a ridge and at least one free ridge end, a ventilation path be provided through a ridge end component.

Typically a Victorian or Edwardian style conservatory will have one or more ridge ends suitable for adoption of the present invention. At such a ridge end glazing bars extend downwardly and radially, a cover sits over the ridge end and a decorative finial is mounted on the cover. In a preferred form of the invention it is proposed that a generally vertical ventilation tube be provided at the ridge end. Then a finial or other decorative cover may be fitted over the ventilation tube leaving a space between edges thereof through which air can escape.

A preferred form of ridge end for a glazed roof according to the invention comprises a flange component of or mounted to a ridge beam end, the flange component being arranged to have ends of glazing bars connected thereto. The ventilation tube is preferably mounted through the flange component. In fact, the tube and flange could be made as a single component, such as a die cast component.

A cover for the roof ridge end preferably has an aperture therethrough for the ventilation tube and is preferably shaped to sit on the ventilation tube top. The aperture preferably has a generally central slot connected by webs to sides of the aperture, the slot being arranged to receive a spigot or the like of a decorative component, such as a finial, whereby the decorative component sits on top of the ventilation tube but has its bottom edge spaced from the cover to provide an air passageway therebetween.

Beneath the roof ridge end a cover panel is preferably provided. The cover panel preferably has an aperture into or over which the ventilation tube sits. Over the aperture there is preferably provided a hit and miss ventilator. Preferably the aperture is covered by a radially slotted cover with an associated rotatable slotted disc, whereby the disc can be rotated between a first position wherein respective slots of the cover and disc are aligned to allow air passage and a second position wherein solid parts of the disc align with slots of the aperture to prevent air passage.

The ventilation system of the invention may be used for natural ventilation. In other words when the ventilation passages are open warm air within a conservatory will rise and escape through the ventilation system. On the other hand forced ventilation may be possible with the ventilation system of the invention by providing an electrically operated fan or rotor within the ventilation tube to draw air through it from the conservatory.

The invention will now be further described, by way of example only, with reference to the accompanying drawings, in which.

Figure 1:
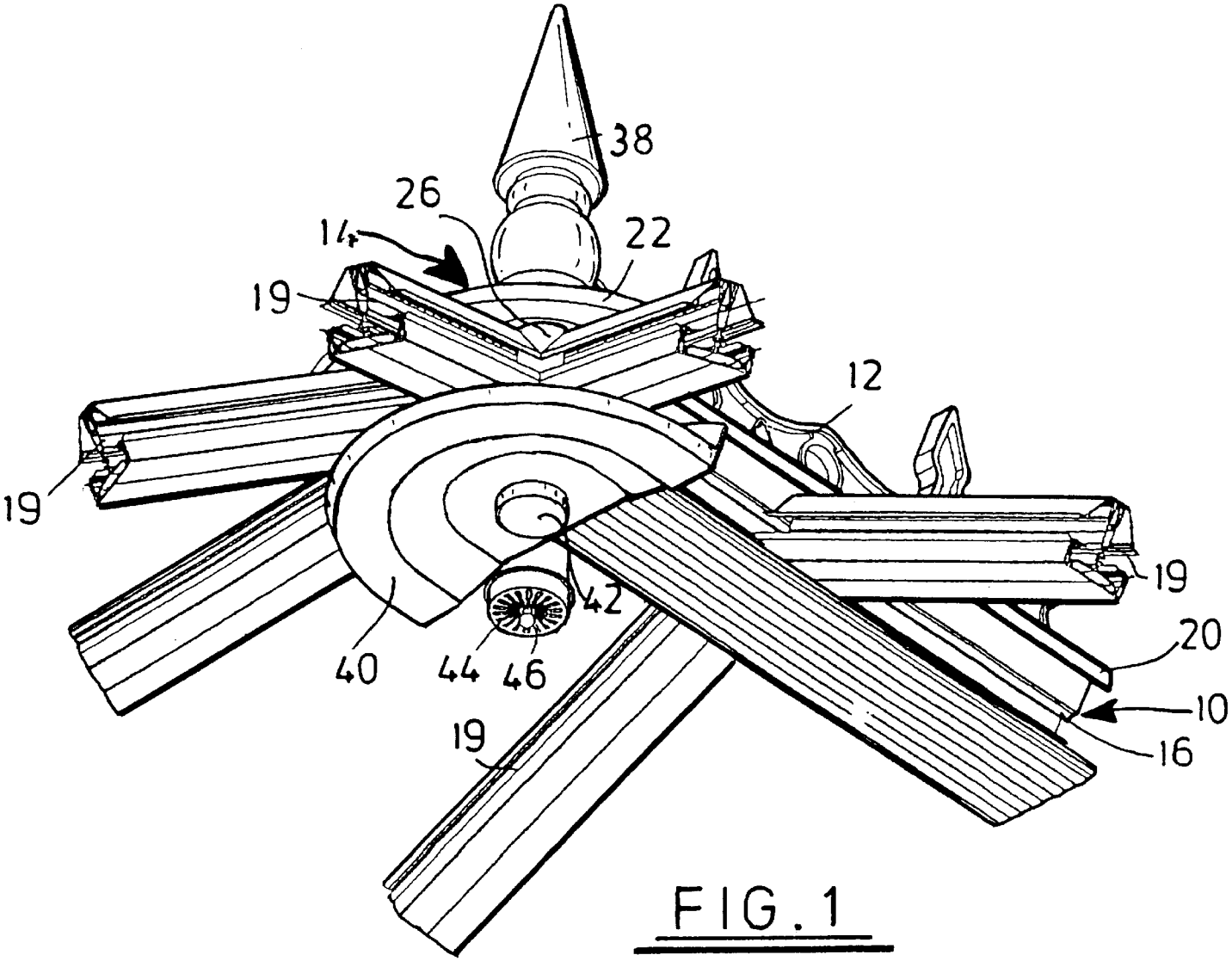
FIG. 1 is a partially exploded view from below of a conservatory ridge end with a ventilation system.
Figure 2:
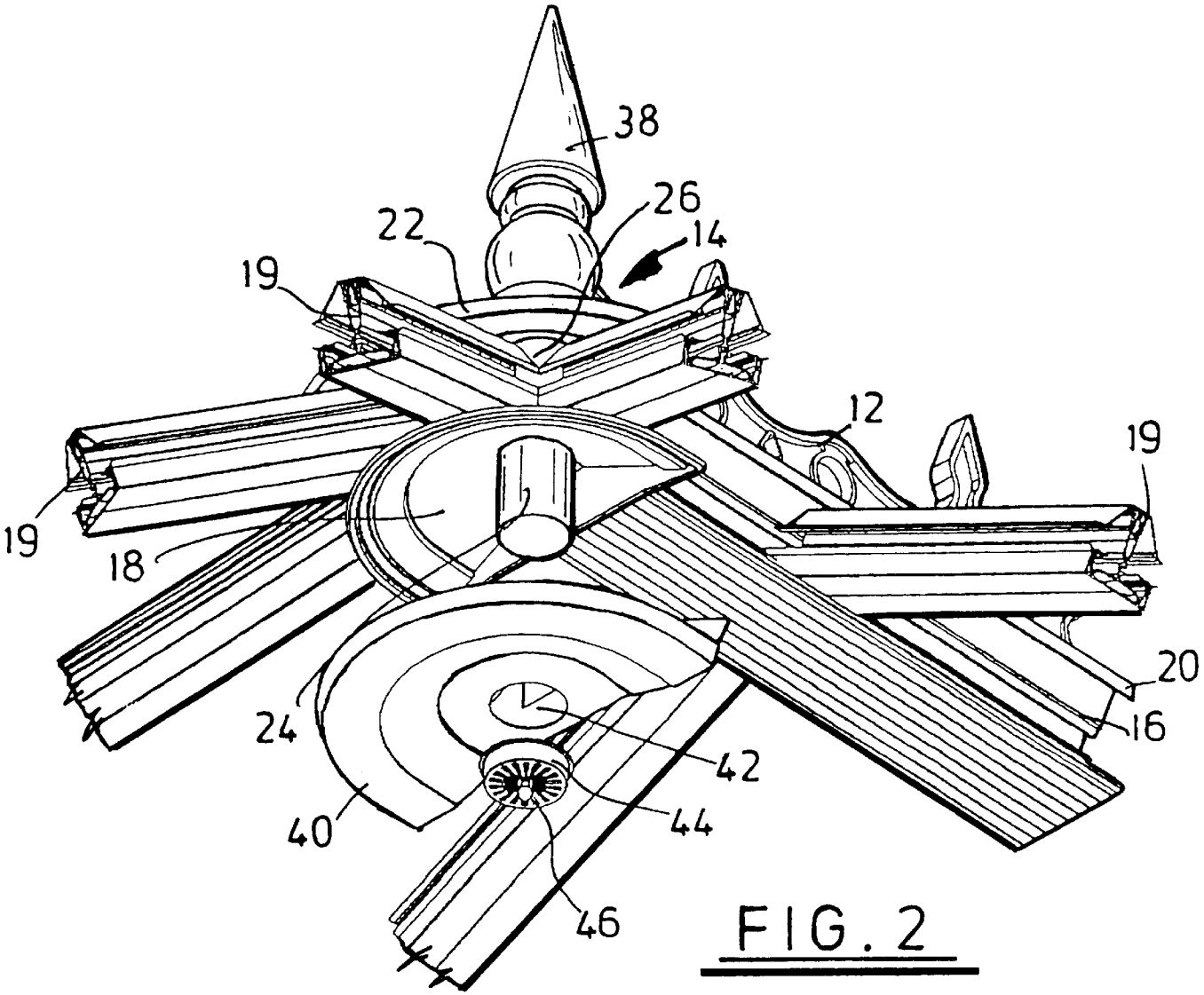
FIG. 2 is a further exploded view from below of the conservatory ridge of FIG. 1.
Figure 3:
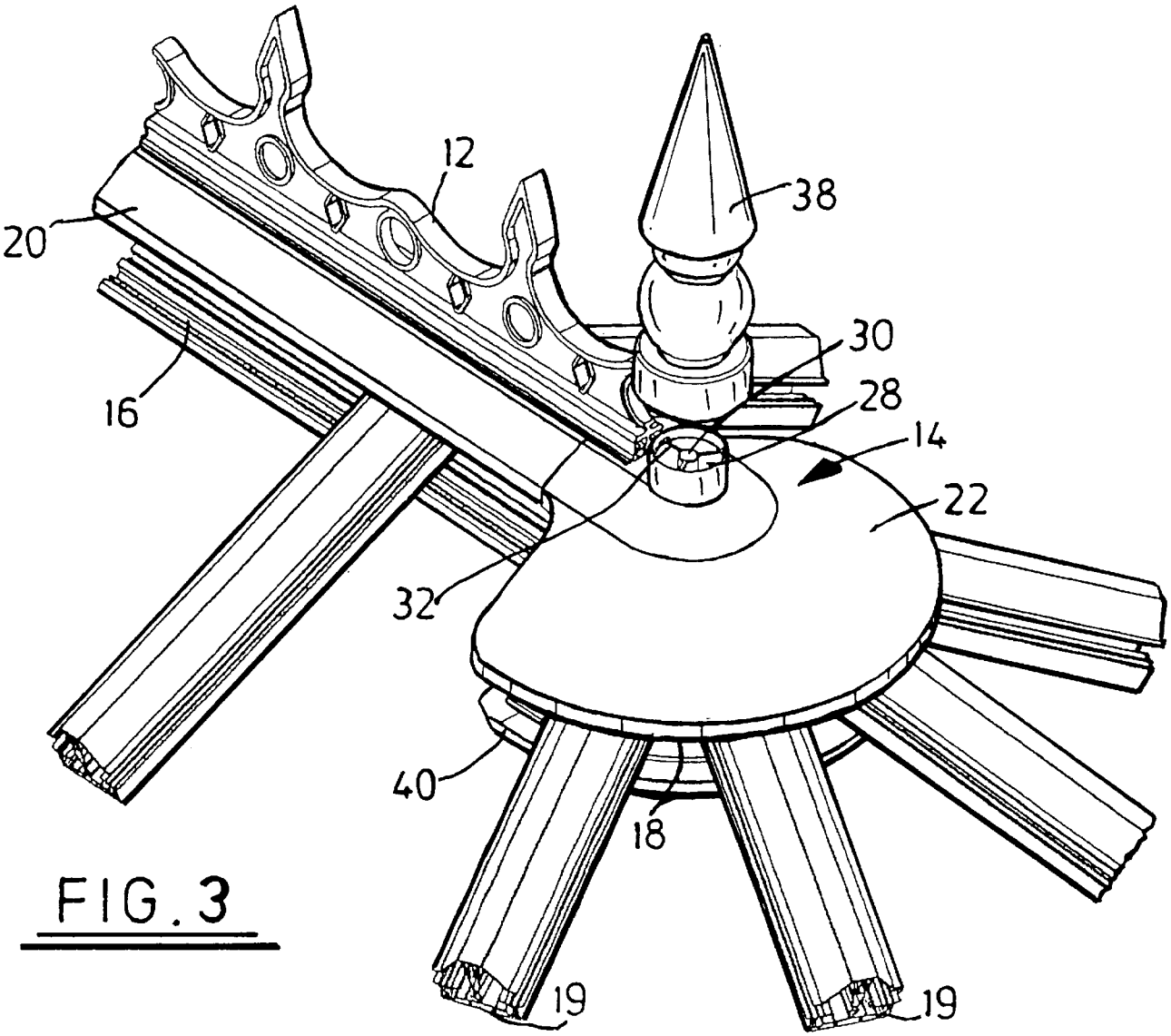
FIG. 3 is a partially exploded view from above of the conservatory ridge end of FIG. 1.
Figure 4:
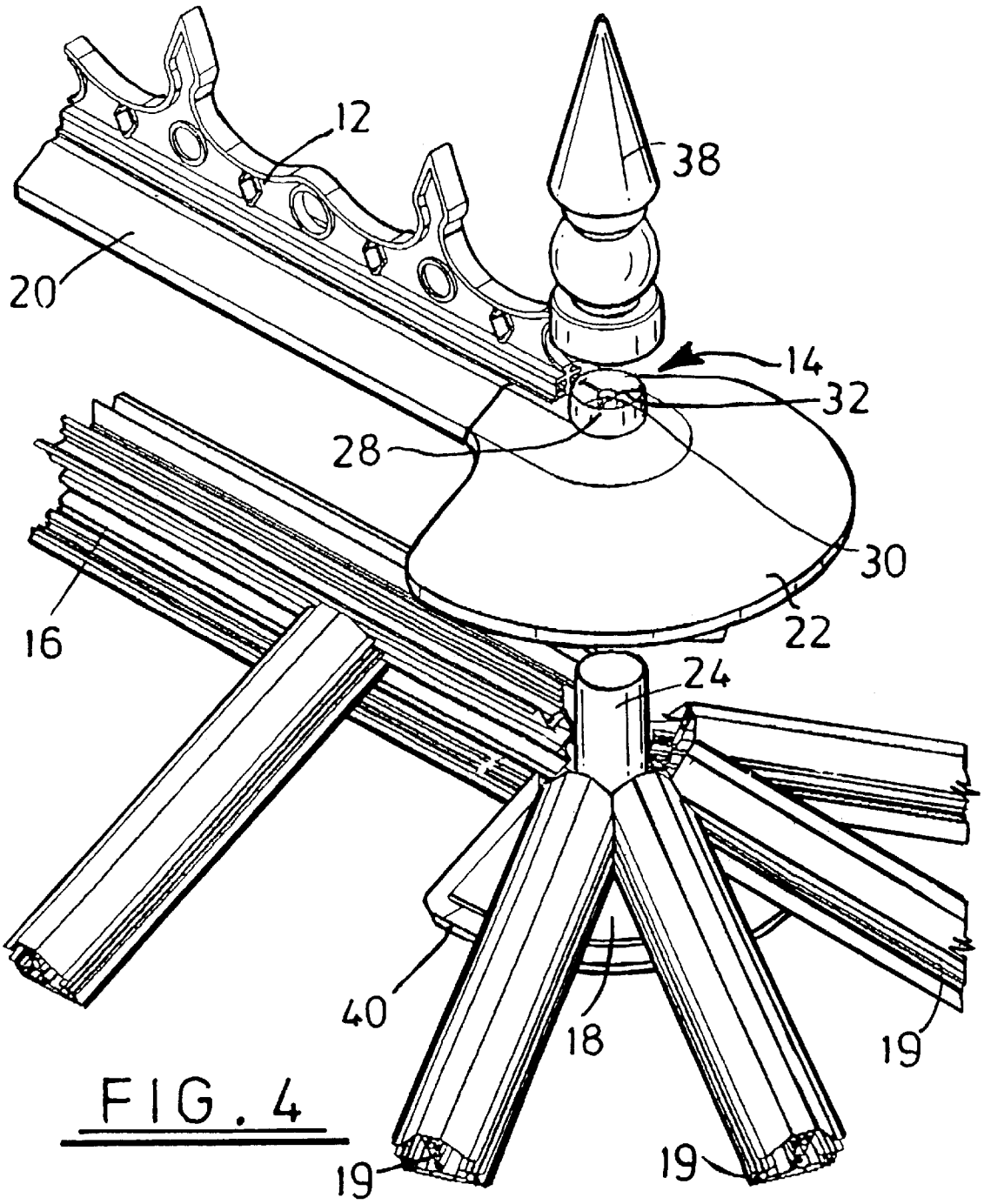
FIG. 4 is a further exploded view from above of the conservatory ridge and of FIG. 1.
Figure 6:
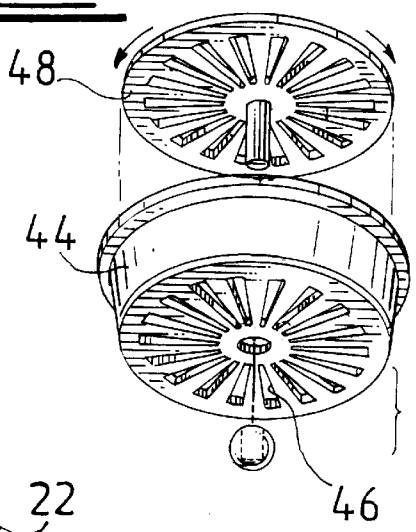
FIG. 6 is an exploded, perspective detail of a ventilation grille and a slotted disc, which appear in FIG. 5.

Referring to the accompanying drawings, the ridge end illustrated is typical of a so-called Victorian conservatory which has a ridge 10 with a decorative cresting 12 and a ridge end generally designated 14 from which glazing bars 19 extend radially and support glazing panels (not shown) therebetween.

The conservatory roof ridge end comprises a ridge beam 16 having a generally semi-circular ridge end plate 18 fixed thereto. The ridge end plate 18 slopes downwardly and has the glazing bars 19 attached thereto.

Over the ridge beam 16 is a capping 20 and at the ridge end is a generally semi-circular capping 22. Extending through the ridge end plate 18 is a ventilation tube 24. The plate 18 and tube 24 may be made as a one-piece die cast item. Space between ends of the glazing bars 19 and the ventilation tube 24 is sealed with foamed plastics material 26.

At its top the ventilation tube 24 extends through a circular aperture 28 in the capping 22. In the aperture 22 is a tube 30 with a closed bottom end connected by webs 32 to sides of the aperture 28. The tube 30 receives a spigot 34 from base 36 of finial 38, such that there is an air space between the bottom edge of the base 36 and the capping 22.

Beneath the ridge end is a cover plate 40. The cover plate has an aperture 42 into which the bottom end of the ventilation tube 24 extends. Covering the aperture 42 is a ventilation grille 44 having a plurality of radial slots 46. Rotatably mounted above the grille 44 is a disc 48 itself having a plurality of radial slots, whereby alignment of the slots of the cover and of the disc permit air passage into and through the ventilation tube 24.

Figure 5:
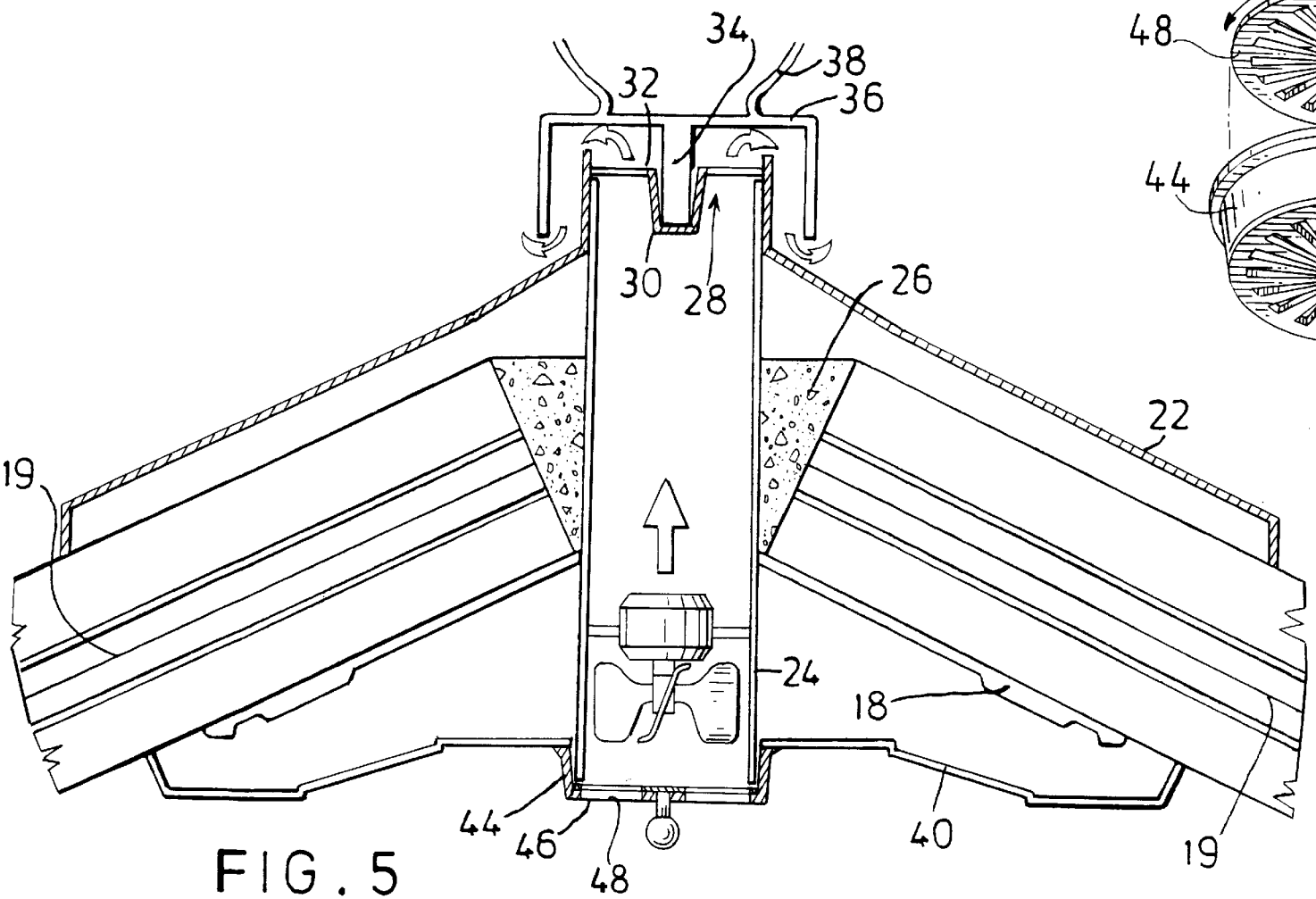
FIG. 5 is a section through the conservatory ridge end of FIG. 1.

The ventilation tube 24 may be provided with an electrically operated fan or rotor F, as shown in FIG. 5, to provide forced ventilation through the ventilation tube. Otherwise ventilation occurs by warmer air within the conservatory rising and passing through the ventilation tube.

What is claimed is:

1. A glazed roof having a ridge with at least one free ridge end, which comprises or mounts a flange component arranged to have ends of glazing bars connected to the flange component, wherein a ventilation tube is mounted through the flange component, the ventilation tube providing a ventilation path through the flange component.

2. A glazed roof as claimed in claim 1, wherein a finial or other decorative cover fitted over the ventilation tube leaving a space between edges thereof through which air can escape.

3. A glazed roof as claimed in claim 1, wherein the ventilation tube and flange component are a single component.

4. A glazed roof as claimed in 1, wherein beneath the roof ridge end a cover panel is provided.

5. A glazed roof as claimed in claim 4, wherein the cover comprises a panel having an aperture into which the ventilation tube sits.

6. A glazed roof as claimed in claim 1, further comprising means for forced ventilation.

7. A glazed roof as claimed in claim 6 further comprising an electrically operated fan within the ventilation tube to draw air through it from the conservatory.

8. A glazed roof as claimed in claim 1, wherein a cover for the free ridge end has an aperture therethrough for the ventilation tube.

9. A glazed roof as claimed in claim 8, wherein the ridge end cover is shaped to sit on the ventilation tube.

10. A glazed roof as claimed in claim 8, wherein the aperture has a generally central slot connected by webs to sides of the aperture, the slot receiving a spigot of a decorative component whereby the decorative component sits on top of the ventilation tube but has its bottom edge spaced from the cover to provide an air passageway therebetween.

11. A glazed roof as claimed in claim 8, wherein over the aperture there is provided a hit and miss ventilator.

12. A glazed roof as claimed in claim 11, wherein the aperture is covered by a radially slotted cover with an associated rotatable slotted disc, whereby the disc can be rotated between a first position wherein respective slots of the cover and disc are aligned to allow air passage and a second passage wherein solid parts of the disc align with slots of the aperture to prevent air passage.

* * * * *